United States Patent [19]

Heckmann et al.

[11] 4,392,510

[45] Jul. 12, 1983

[54] CONTROL VALVE FOR VISCOUS MATERIAL PUMPS

[75] Inventors: Horst Heckmann, Sprockhövel; Werner Nawroth, Waltrop, both of Fed. Rep. of Germany

[73] Assignee: Friedrich W. Schwing, GmbH, Herne, Fed. Rep. of Germany

[21] Appl. No.: 429,020

[22] Filed: Sep. 30, 1982

Related U.S. Application Data

[63] Continuation of Ser. No. 236,568, Feb. 20, 1981, abandoned.

[30] Foreign Application Priority Data

Feb. 21, 1980 [DE] Fed. Rep. of Germany ..... 3006542

[51] Int. Cl.[3] ..... F16K 27/04; F16K 3/00

[52] U.S. Cl. ..... 137/454.2; 137/625.18; 137/625.48; 251/329

[58] Field of Search ..... 137/454.2, 625.18, 625.48, 137/872, 375; 251/326, 327, 328, 329, 367; 417/516, DIG. 900, 317

[56] References Cited

U.S. PATENT DOCUMENTS

| | | | |
|---|---|---|---|
| 2,998,781 | 9/1961 | Triebel | 417/900 |
| 3,327,634 | 6/1967 | Whiteman, Jr. | 417/317 |
| 3,640,303 | 2/1972 | Verheul | 251/326 |
| 3,650,641 | 3/1972 | Reinert | 137/625.44 |
| 4,215,713 | 8/1980 | Kuhlmann | 417/900 |

FOREIGN PATENT DOCUMENTS

| | | |
|---|---|---|
| 654112 | 12/1937 | Fed. Rep. of Germany . |
| 1905706 | 2/1970 | Fed. Rep. of Germany . |
| 1813237 | 6/1970 | Fed. Rep. of Germany . |
| 1908741 | 9/1970 | Fed. Rep. of Germany . |
| 1578943 | 7/1969 | France . |

OTHER PUBLICATIONS

German Patent Application, published 12/77, GM 7727633, *Schwing,* all pages.

*Primary Examiner*—Martin P. Schwadron
*Assistant Examiner*—John A. Rivell
*Attorney, Agent, or Firm*—Andrus, Sceales, Starke & Sawall

[57] ABSTRACT

A control valve for viscous material pumps has a valve plate reciprocally movable in a flat housing divided in half to control the flow channels of the valve. The plate is movable in a wear shell inlaid in the housing and having covering rings along the flow channels.

5 Claims, 7 Drawing Figures

Figure 2:
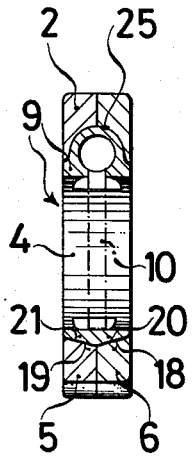

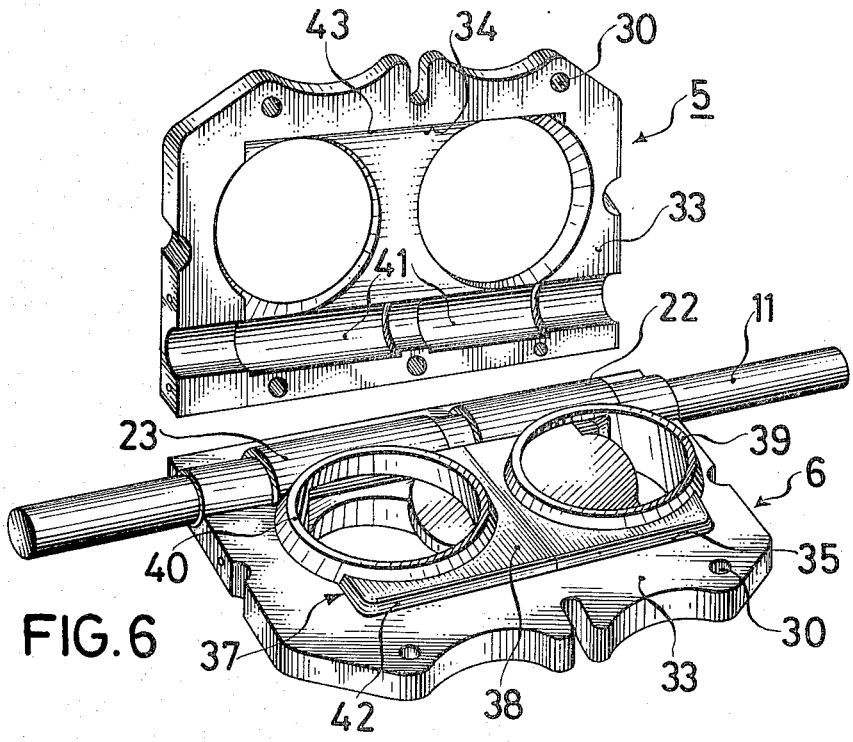
FIG. 6
FIG. 7
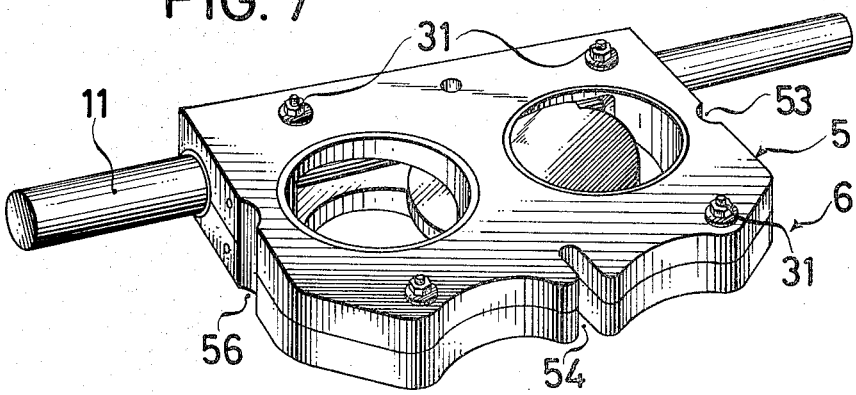

CONTROL VALVE FOR VISCOUS MATERIAL PUMPS

This application is a continuation application of Ser. No. 236,568, filed Feb. 20, 1981, now abandoned.

The invention relates to a control valve for viscous material pumps. The control valve has a valve plate with at least one valve rod, the plate being reciprocally movable in a flat housing for alternate in and out control of channels traversing the housing and passing the viscous material. The housing is formed of a pair of halves.

The invention relates in particular to the pumps of thick materials, which abrasively act and thus, moreover contain fine grained solid material. Therefore the invention is suited particularly for concrete pumps, because concrete contains sharp edged ingredients and cement slurry, that also separates from the water. The control valve according to the invention with its flat housing can, for example, be installed in a conduit directing means between the flanges of a hose conduit and a supply or discharge conveying conduit. Preferably, however, it is mounted on concrete pumps between the body of a reservoir and the discharge conduits of a two cylinder-piston pump and/or the supply conduit and the discharge conduits.

In such a control valve must high demands be placed because its regular work is critical not only for the supply of the viscous material, circumstances permitting, over considerable heights and distances with the corresponding high pressures, but also the quality of the pumped viscous material is dependent somewhat on the concrete conveying. On the one hand must therefore the highly stressed parts of the valve slide be protected against wear proceeding from the sharp edged ingredients of the viscous material, on the other hand, a good sealing is desired, particularly against the egress of the fine ingredients, as for example the cement slurry, the losses of which impair the quality of the concrete.

The initially described control valve is already known (DBP No. 19 05 706). The exterior sealing is provided by a packing sleeve which surrounds the conduit, that is drawn around on both ends of the valve slide rod and moves with these with the back and forth reciprocation of the valve slide in the dividing plane of the housing before the opening of both adjacently arranged channels.

Experience has, however, shown that the wear appears between the movable and non-movable parts of the control valve all together, because fine grained solid material is driven in the clearances existing of necessity between movable and stationary construction parts and there, on the one hand, effects friction on the parts and, on the other hand, incrementally ages; when referring to the parts of the hydraulic cement, the aging results in that the housing halves, circumstances permitting, can no longer be separated from each other.

One has made an effort to solve the wear problem among other things through inlaying and fastening of wear plates in the housing in particularly high stressed housing parts. These wear plates concern massive bodies of suitable metal alloys, which are formed out of a proportionately tough and wear resistant steel. The thereby obtainable result is naturally limited to the respective places of the housing and thus does not offer full wear protection. The replacement of the wear surfaces requires the loosening of the fastening means, for example, screws or welding seams.

One has further attempted to solve the wear problem through construction of the valve housing in compound casting. Such housings are however very complicated and difficult to connect with suitable pouring technology. Slide valve housings, which are protected with a high wear resistant outer surface in the entire region passing the viscous material, cannot, according to this proposal, be economically produced.

The present invention has as its object to provide a full wear protection in the foregoing sense, that can not only be easily mounted in the housing but also can be further removed out of same, if it is installed and should be exchanged for fresh wear protection.

According to the invention is this object attained in that the slide valve plate and the slide valve rod are movable in a wear shell surrounding them and provided with covering rings for the housings channels. The wear shell is assemblable out of a plurality of hollow bodies threadable from a side on the slide valve rod and is form lockingly inlaid in a recess of the inner sides of the housing halves. According to a preferred exemplary embodiment of the invention it is provided that the bordering edges running normal to the flat sides of the wear shell provided with the covering rings have roof formed arranged inclines, with which correspondingly inclined surfaces are arranged on the boundary edges of housing recess containing the wear shell.

The formation of the wear protection in the form of the described shell inlayable in the housing halves, that is preassembled out of a plurality of hollow bodies over the flat valve slide and the valve rod, withdraws the housing fully from the effect of the viscous material and the movable parts. As material for the cast wear shell comes in particular into consideration a chromium and vanadium containing alloy, in which one to a certain extent formulates toughness in order to lessen the rupture danger.

The preferred exemplary embodiment of the invention leads moreover in that the viscous material driven in the gap between movable parts and stationary parts strikes on the wear resistant material on the stationary parts, formed of the shell. For this, the initially referred to ductile metal alloys are therefore particularly suited out of which the wear shell can be cast. The mounting of such a shell basically requires clean surfaces, on which the form locking takes place, so that the wear shell as compared with the movable parts of the control slide valve is restrained during the operation. The dissassembly is problem free because the beveled surfaces, with the raising of the housing valves from the wear shell leads to corresponding force components in the surface planes, which produce shearing forces in the cement so that it, in that way, immediately loosens.

Preferably one simplifies the control valve according to the invention in that one divides the wear shell into similar hollow bodies. For this purpose, the wear shell is divided in similar halves along a separating plane running normal to the dividing plane of the housing, said halves forming a unit with the covering rings. Such an exemplary embodiment provides the possibility of realizing the wear shell with a proportionately simple casting piece.

Therefore it is also suggested to likewise divide in similar halves the control valve housing that accommodates the wear shell. Thus it is according to another exemplary embodiment of the invention that the wear shell receiving recess in the housing is formed in half in each of the pair of congruent housing halves.

On the other hand it is naturally expedient to reduce the size of the wear shell to the absolutely necessary measurements. That is accomplished with an exemplary embodiment of the invention in that the wear shell rectangular in the housing plane has arranged on at least one of its long sides, guide sleeves for a valve slide rod unitary with its hollow bodies and has on the other longitudinal side a guide unitary with the hollow bodies for a bordering edge of the sliding plate and that the small dimensions of the wear shell between the faces of the guides are bent corresponding to the covering rings. There thus results a form for the wear shell that has closed working surfaces in all directions and thus improves the form locking.

Figure 1:
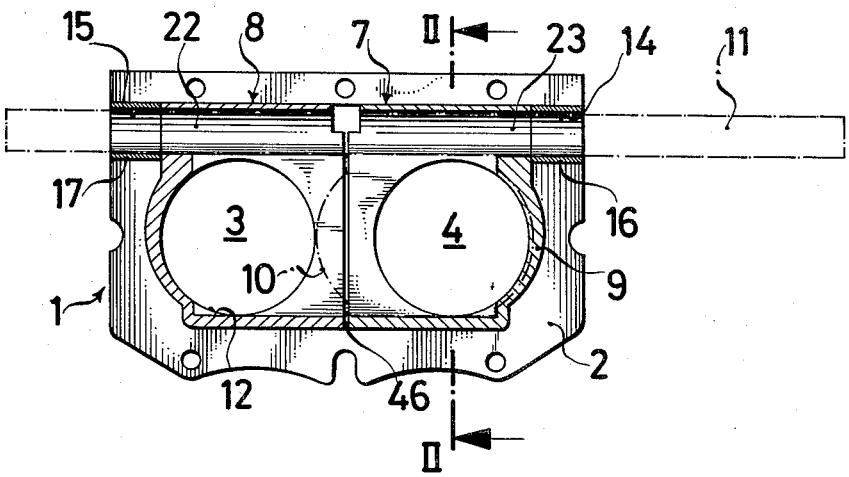
Figure 3:
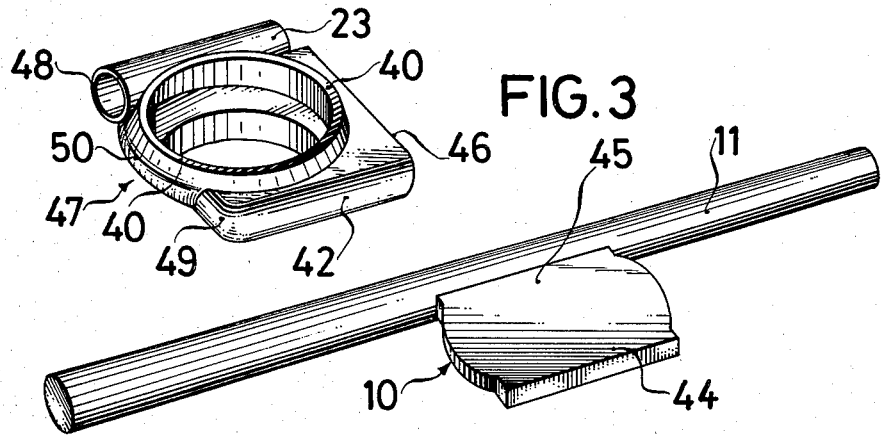
Figure 4:
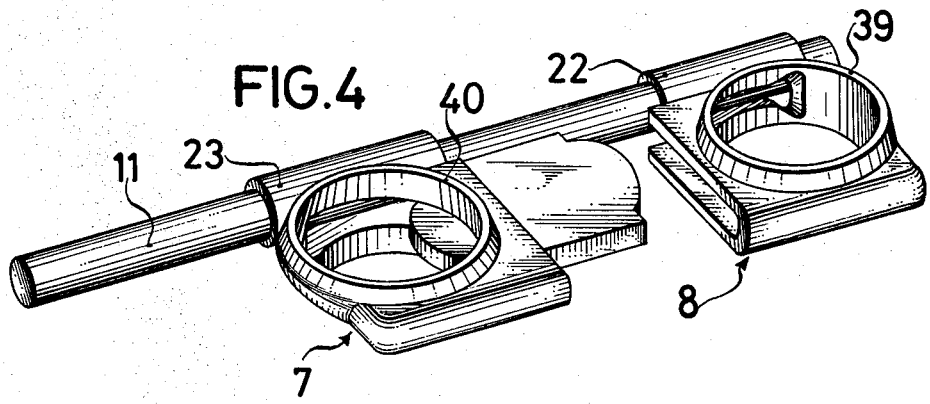
Figure 5:
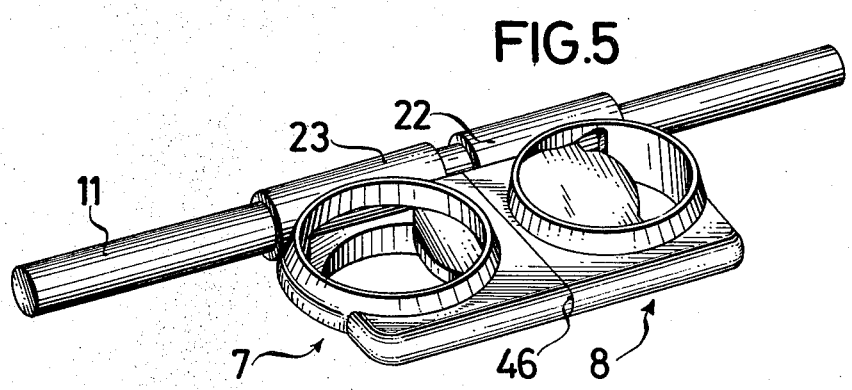

The details, further features, and other advantages of the invention will appear from the following description of an exemplary embodiment with the aid of the figures of the drawing, which show:

FIG. 1, in plan view, partially in section, an open slide valve housing according to the invention, FIG. 2, a closed slide valve housing in section along the line II—II of the FIG. 1, FIG. 3, the assembly of the wear shell over the valve plate in a first phase and in perspective view, FIG. 4, in a view corresponding to FIG. 3 a further phase with the assembly of the wear shell, FIG. 5, in a view corresponding to FIGS. 3 and 4 the finished assembled wear shell, FIG. 6, in likewise perspective view, the inlaying of the parts in the open valve housing and FIG. 7, in the view corresponding to FIG. 6, the closed housing after the final assembly.

The housing reproduced in the FIGS. 1 and 2 is, as compared with the view in the FIGS. 3–7 schematic, that is, reproduced in simplified line drawing. This view should make apparent the basic construction of the control valve according to the invention, which is indicated with 1. The flat valve housing 2 has therein two adjacently arranged flow channels 3, 4 for a viscous material, for example, concrete and is, as can be seen in FIG. 2, assembled out of two similar halves 5 and 6. On the inner side, both halves carry a recess for the mounting of the wear shell 9, for its part divided into similar halves 7, 8. The wear shell encloses the flat slide valve plate 10 reproduced in dotted lines in FIG. 1 and those parts of the valve rod 11 that are arranged adjacent the plate 10 run in the housing. The wear shell 9 is form lockingly inlaid in a closed recess 12 of the housing 2; the housing has corresponding recesses 14 and 15 through which the slide valve rod 11 is lead to the exterior. These recesses are lined with the wear sleeves 16 and 17.

As can be seen from the FIG. 2, the wear shell 9 has roof formed inclined surfaces 18 and 19 attached on its outer edges that coact with correspondingly beveled surfaces 20 and 21 of the housing.

These slanting surfaces are mounted wherever no bent surfaces of the housing or the wear shell are necessary. That is the case, with the exemplary embodiment, only in the region of the pipe-like guide parts 22, 23 of the wear shell 9 that are provided for the valve slide rod 11. These parts have rounded off outer edges, as is apparent by 25 in FIG. 2.

It is also not absolutely necessary to mount the inclined surfaces 18, 19 and 20, 21 along the entire surface of the referred to edges, because the loosening effect with the separation of the housing halves can already suffice if the inclined surfaces are arranged only outside on the referred to edges.

In the FIGS. 3–7 the details of the control valve are clearly seen.

According to FIGS. 6 and 7 the housing halves 5, 6 have a plurality of holes 30, which can be aligned with each other and accept fastening bolts 31, which fasten together both housing halves 5 and 6. The pair of housing halves 5 and 6 are similar castings and also the wear shell is formed of two similar hollow bodies 7, 8. For the assembly on the inside 33, each housing half 5, 6, is provided with a respective half 34, 35 of a recess 37 that accepts the wear shell 9. The recess is so formed that the wear shell can be fitted with a flat middle part 38 on the plane of its outer surface providing covering rings 39, 40 for the channels 3, 4 mounted in the housing halves 5, 6. Moreover, the pipe guides 22, 23 are engaged by 41 and a guide 42 by 43.

As FIG. 3 shows a guide edge 44 runs in the guide 42, the former being formed as a unit on the valve plate 10 and which has, on the oppositely lying side, a fastening border 45, with which it is fastened on the sliding valve rod 11.

According to the exemplary embodiment, the wear shell 9 is, as can be seen from the example from FIG. 1, divided in similar halves along a separating plane 46 running normal to the dividing plane of the housing, said halves being carried out by the pair of hollow bodies 7, 8. Each hollow body forms an element with the covering rings 39, 40 and the parts of the guide 42 or the guide pipe 23 arranged with it. As a result of the described position of the separating plane 46 a narrow side 7, 8 of the wear shell is formed on each half. According to the exemplary embodiment, staggered faces 48, 49 of the guide pipes 22, 23 and the guide 42 respectively, lie on this narrow side 47. Therebetween is located a bend 50 that corresponds to the curvature of the covering rings 39, 40.

As is apparent from FIG. 3, the hollow body 7 is initially threaded from the left on the guide rod 11. It is slid sufficiently far to the right until the guide border 44 or the therewith associated bend of the valve plate 10 comes into place in the corresponding inner side of the hollow body 40. In a corresponding manner the hollow body 8 is pushed from the right according to FIG. 4 until both hollow bodies rest on the separating plane 46 as is reproduced in FIG. 5.

The so assembled parts are, according to FIG. 6, inlaid from above in the lower housing part 6, that is, in the there located half 35 of the recess, after which the initially described wear sleeves 16, 17 are threaded on the ends of the valve plate rod 11. Then can the upper housing half 5 be shut so that the bolts 31 can be introduced and tightened.

The housing 10 can be lockingly fastened between flanges as a result of the mounted edge recess 53–56 on its circumference.

The sliding valve rod 11 coacts on both its ends with a piston, that runs with oil pressure actuated cylinders, which find use as a drive for the sliding valve plate.

We claim:

1. A control valve for viscous material pumps comprising:

a flat housing (2) having a pair of generally parallel exterior surfaces, said housing having a pair of laterally spaced viscous material channels (3, 4) extending therethrough normal to said exterior surfaces, said housing being formed of two parts (5, 6) abutting along a joinder plane lying parallel to said exterior surfaces;

a valve slide in said housing having a valve plate (10) fastened to valve rod (11) for reciprocal movement within said housing across one or the other of said channels for controlling the movement of material through said channels; and a wear shell (9) mounted in said valve housing and containing said valve plate with said valve rod extending therefrom, said wear shell being formed of a pair of generally similar halves (7, 8) divided along a central plane (46) lying normal to the movement of said valve slide, said wear shell halves being assemblable to form said wear shell by threading them on opposite ends of said valve rod (11), said wear shell being formed for permitting the reciprocal movement of said valve slide and having a pair of openings aligned with said channels, said wear shell being retained in said housing by locking engagement with the interior of said housing and having annular projections (39, 40) around said openings extending into said channels (3, 4) for lining same.

2. The control valve according to claim 1 wherein the exterior of said wear shell halves and annular projections have inclined surfaces (18, 19) engaging complementary inclined surfaces (20, 21) in said housing for the locking engagement of said wear shell in said housing.

3. The control valve according to claim 1 wherein said housing contains a recess (37) in each of said two parts (5, 6) for receiving said wear shell (9).

4. The control valve according to claim 1 wherein said valve plate (10) is fastened along one edge to said valve rod (11) and wherein said wear shell has a pair of parallel sides, one of said sides having guide sleeves (22, 23) for said valve rod integrally formed with said wear shell halves, the other of said sides forming a guide (42) for said valve plate, the ends of said wear shell being convexly curved in correspondence with the annular projections of said wear shell.

5. The control valve according to claim 4 wherein the ends of said wear shell have offset surfaces (48, 49).

* * * * *